United States Patent [19]

Lodini

[11] Patent Number: 4,876,420

[45] Date of Patent: Oct. 24, 1989

[54] CONTINUOUS FLEXIBLE ELECTRIC CONDUCTOR CAPABLE OF FUNCTIONING AS AN ELECTRIC SWITCH

[75] Inventor: Paolo Lodini, Turin, Italy

[73] Assignee: LEDA Logarithmic Electrical Devices for Automation S.r.l., Turin, Italy

[21] Appl. No.: 201,489

[22] Filed: Jun. 2, 1988

[30] Foreign Application Priority Data

Jun. 2, 1987 [IT] Italy ..... 472 A/87

[51] Int. Cl.[4] ..... H01H 3/14

[52] U.S. Cl. ..... 200/86 R; 338/114; 340/667

[58] Field of Search ..... 340/665, 666, 667; 200/85 R, 85 A, 86 R, 86 A, 86.5, 61.41, 61.43, 292; 307/119; 338/114 X, 99, 100

[56] References Cited

U.S. PATENT DOCUMENTS

| | | | |
|---|---|---|---|
| 4,172,216 | 10/1979 | O'Shea | 338/114 |
| 4,258,100 | 3/1981 | Fujitani | 338/114 |
| 4,317,970 | 3/1982 | Hafner | 200/86 R |
| 4,529,959 | 7/1985 | Ito | 338/114 |
| 4,570,149 | 2/1986 | Thornburg | 338/114 |
| 4,757,297 | 7/1988 | Frawley | 338/214 |

*Primary Examiner*—Gerald P. Tolin

*Attorney, Agent, or Firm*—Klauber & Jackson

[57] ABSTRACT

A conductor comprising a first elongated electric conducting element; a spacer element formed from insulating material and placed over the surface of the first conducting element, so as to shield all but given portions of the aforementioned surface; a second tubular electric conducting element placed over the outside of the aforementioned spacer element; a third tubular electric conducting element placed over the outside of the aforementioned second element; and a tubular insulating sheath placed over the outside of the aforementioned third conducting element. The structure of the aforementioned second conducting element comprises a supporting matrix formed from flexible, electrically-insulating material and particles of electrically-conductive material scattered in random, substantially uniform manner inside cells on the aforementioned matrix; which cells communicate at least partially with one another, and are at least partially larger in size than the respective particles of electrically-conductive material housed inside the same.

4 Claims, 7 Drawing Sheets

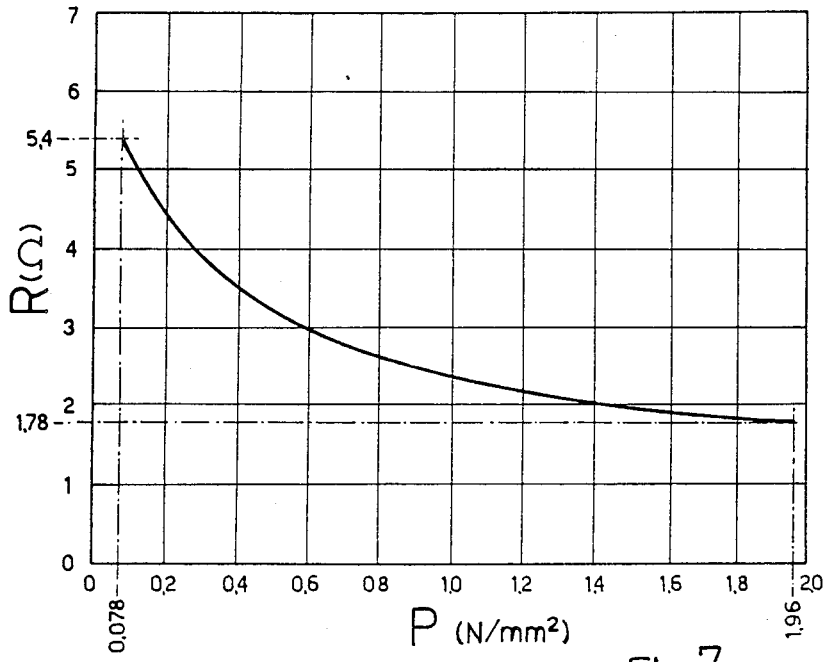
Fig.7
Fig.8
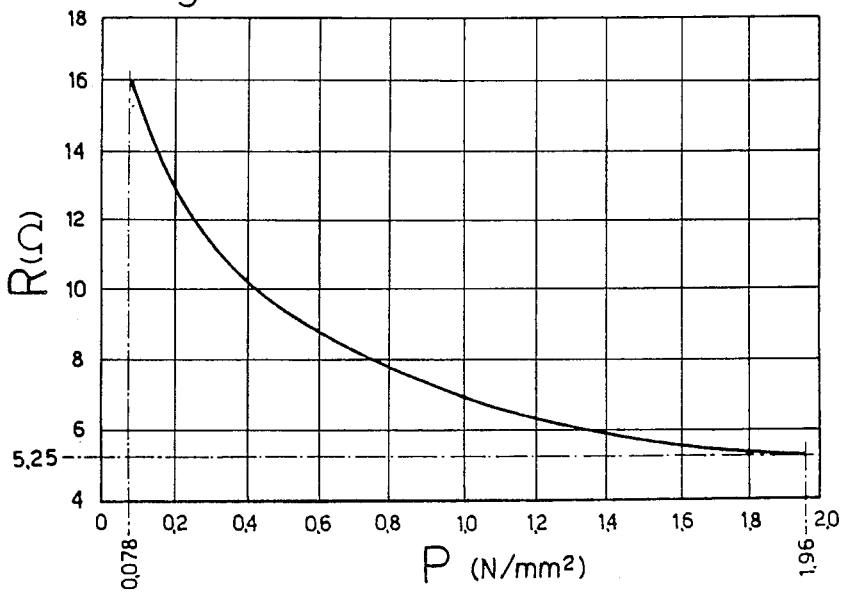

CONTINUOUS FLEXIBLE ELECTRIC CONDUCTOR CAPABLE OF FUNCTIONING AS AN ELECTRIC SWITCH

REFERENCE TO RELATED APPLICATION

This Application is a Continuation-in-Part of U.S. Pat. application Ser. No. 07/145,612, filed Jan. 19, 1988, to the same Applicant and entitled Process for Producing Electric Resistors having a Wide Range of Specific Resistance Values.

BACKGROUND OF THE INVENTION

The present invention relates to a continuous, flexible electric conductor suitable for employment on an electric line, and capable of functioning as an electric switch. Electric current is known to be supplied between source and user equipment over an electric line, to which the said elements are series-connected, and which also comprises at least one electric switch, also series-connected to the line and which, when closed, allows current to flow from the source to the user equipment.

For controlling the electric circuit at various points along the said line, provision is made for a number of switches, each series-connected electrically to the source and user equipment. In this case, the line comprises at least two conducting wires, which must be connected, e.g. welded, to the connecting terminals on the said switches, as well as to the terminals on the source and user equipment.

An electric line of the aforementioned type therefore involves a considerable number of both connections and component parts (i.e. switches), the consequences of which are high cost and greater breakdown potential along the line caused, for example, by loose wires or infiltration, e.g. by water, on the switch connecting terminals.

Furthermore, changes to such a line, e.g. re-allocation of the switches, can only be made with difficulty, which also applies to re-utilization of the component parts of the line (conducting wires and switches).

SUMMARY OF THE INVENTION

The aim of the present invention is to provide a continuous, flexible electric conductor also capable of functioning as an electric switch, and which provides for forming electric lines involving none of the aforementioned drawbacks.

With this aim in view, according to the present invention, there is provided a continuous, flexible electric conductor, characterised by the fact that it comprises a first elongated electric conducting element; a spacer element formed from insulating material and placed over the surface of the said first conducting element, so as to shield all but given portions of the said surface; a second tubular electric conducting element placed over the outside of the said spacer element; a third tubular electric conducting element placed over the outside of the said second element; and a tubular insulating sheath placed over the outside of the said third conducting element; the structure of the said second conducting element comprising a supporting matrix formed from flexible, electrically insulating material and particles of electrically-conductive material scattered in random, substantially uniform manner inside cells on the said matrix; said cells communicating at least partially with one another, and being at least partially larger in size than the respective particles of said electrically-conductive material housed inside the same.

The said structure of the said second electric conducting element is of the type described in U.S. Pat. application No. 07/145,612 filed Jan. 19, 1988, and entitled: "Electric resistor designed for use as an electric conducting element in an electric circuit, and relative manufacturing process."

BRIEF DESCRIPTION OF THE DRAWINGS

The present invention will be described, by way of example, with reference to the accompanying drawings, in which.

Figure 11:
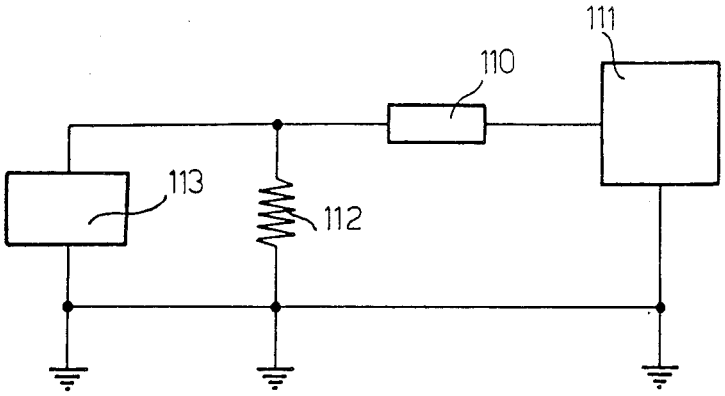
Figure 10:
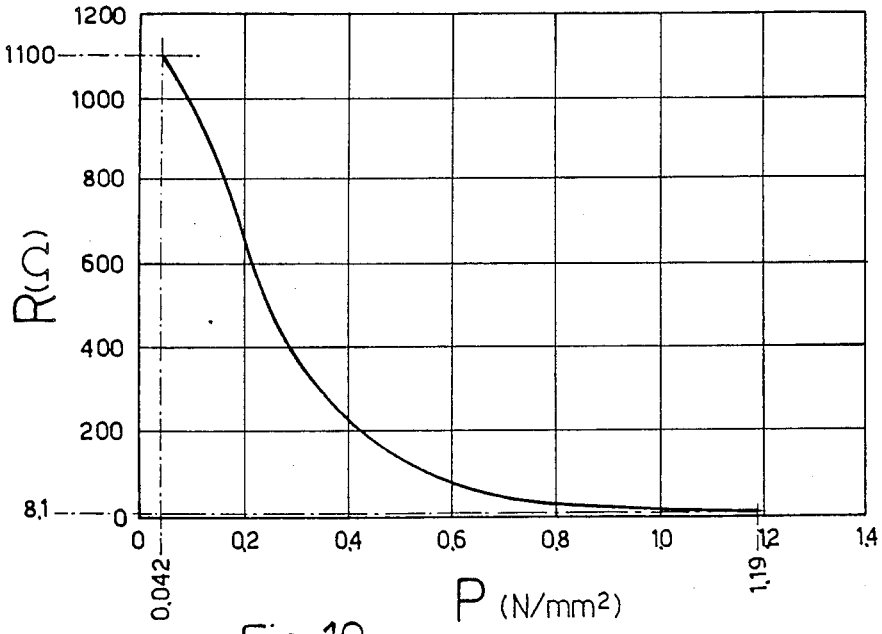

The graphs in FIGS. 7 to 10 show the variation in electrical resistance of the resistor according to the present invention, as a function of the pressure exerted on the resistor itself;

FIG. 11 shows a schematic diagram of a test circuit arrangement for plotting the results shown in FIGS. 7 to 10; and FIGS. 12 to 16 show schematic diagrams of the basic stages in the process for producing the electric resistor according to the present invention.

DETAILED DESCRIPTION OF THE INVENTION

Figure 1:
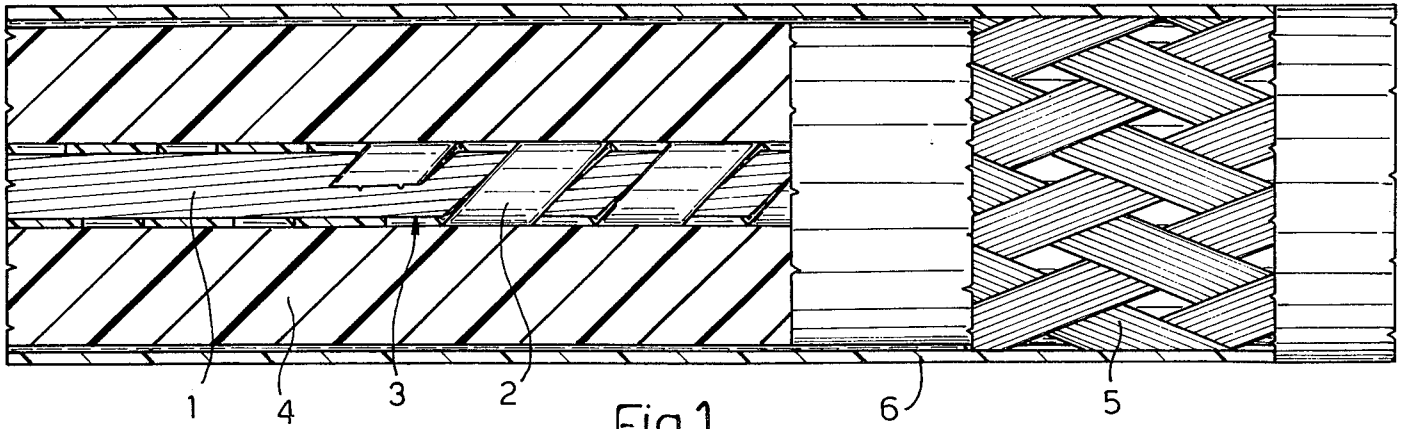
FIG. 1 shows a longitudnal section of a length of the conductor according to the present invention.

The continuous, flexible electric conductor according to the present invention, a short length of which is shown in FIG. 1, comprises a first elongated electric conducting element 1, and a spacer element 2 formed from insulating material and placed over surface 3 of the said first element, in such a manner as to shield all but given portions of the said surface 3. In the embodiment shown in the accompanying drawings, the said spacer element 2 substantially consists of a continuous tape wound about the said surface 3, the said exposed portions therefore consisting of the portions of surface 3 lying between successive turns of the said tape.

The conductor according to the present invention also comprises a second, tubular electric conducting element 4 having its inner surface resting on the outer surface of the said spacer element 2; a third, tubular electric conducting element 5 having its inner surface resting on the outer surface of the said second element 4, as shown clearly in FIG. 1; and a tubular sheath 6 formed from insulating material and placed over the said third conducting element 5.

Figure 3:
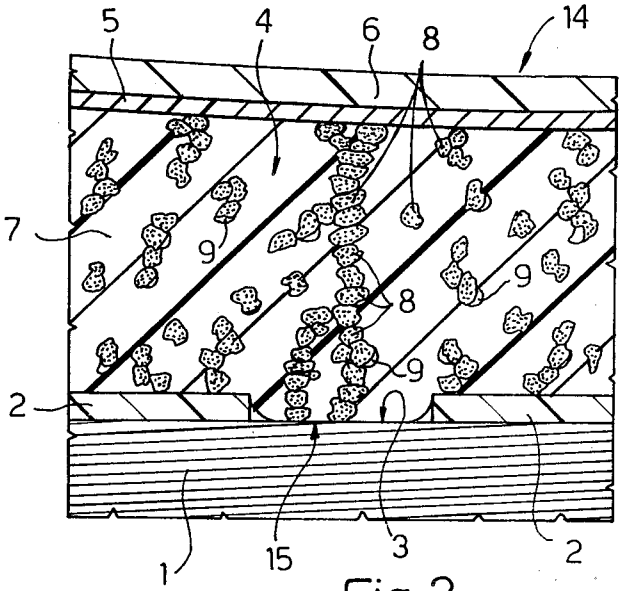
FIG. 3 shows the structure of the material with which is formed the second electric conducting element forming part of the electric conductor according to the present invention.

The structure of the material from which the said second conducting element 4 is formed is as shown in FIG. 3, and substantially comprises a supporting matrix 7 formed from flexible, electrically-insulating material and particles 8 of electrically-conductive material scattered in random, substantially uniform manner inside cells on the said matrix. The said cells communicate, at least partially, with one another, and are, at least partially, larger than the respective particles of electrically-conductive material housed inside the same, so as to leave a gap 9 (FIG. 3) between the outer surface of each particle and the surface of the respective cell.

The above material is described in detail in U.S. Pat. application No. 07/145,612 filed Jan. 19, 1988, by the present Applicant and entitled: "Electric resistor designed for use as an electric conducting element in an electric circuit, and relative manufacturing process", the entire disclosure of which is incorporated herein by reference.

As stated in the above patent application, the said material is electrically-conductive enough for it to be actually employed as an electric conductor. Furthermore, when pressure is applied on the said material, there is a fall in electric resistance measured perpendicular to the pressure direction; which fall in resistance increases alongside increasing pressure.

Such favourable performance is probably due to improved electrical conductivity of chains of particles 8. In fact, in addition to improving the conductivity of contacting particle chains, increasing pressure also renders conductive any chains having gaps 9 between adjacent particles, by bridging the said gaps 9 and so enabling adjacent pairs of otherwise non-conductive particles to become conductive when sufficient external pressure is applied.

To enable a clearer understanding of the process according to which the second conducting element 4 is formed, a description will first be given of the structure of the resistor so formed.

Figure 5:
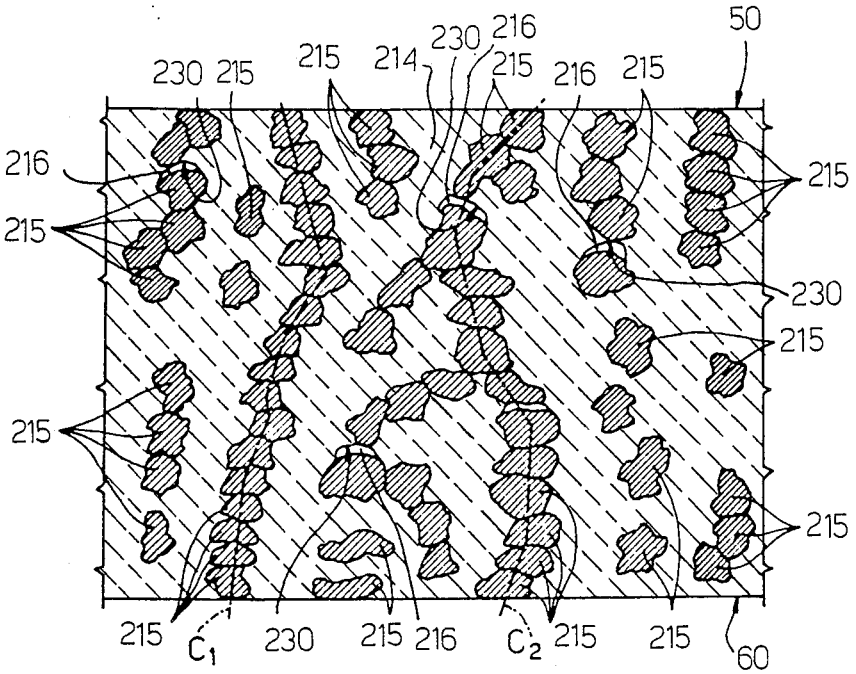
FIGS. 5 and 6 show two structural sections, to different scales, of a portion of the resistor according to the present invention.
Figure 6:
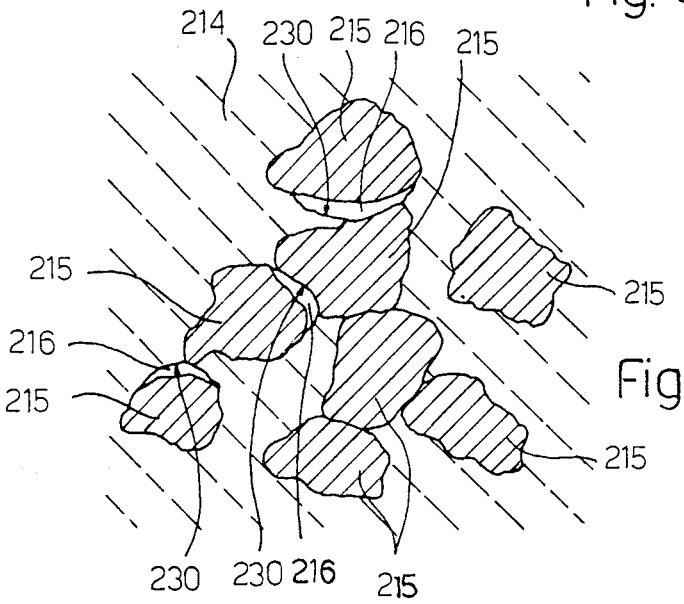
Figure 9:
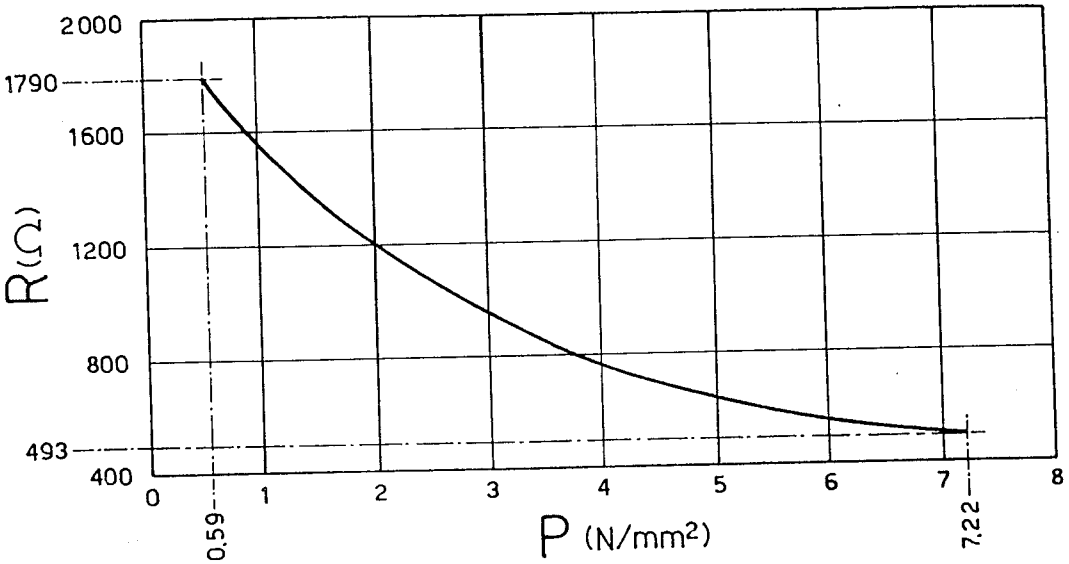

The structure of the resistor is as shown in FIGS. 5 and 6, which show sections of a portion of the resistor enlarged a few hundred times.

The said resistor substantially comprises a supporting matrix 214, formed from flexible, electrically insulating material, and particles 215 of electrically conductive material arranged in substantially uniform manner inside corresponding cells 230 on the said matrix 214. As in the embodiment shown, the said particles preferably consist of granules of electrically conductive material. As shown in the larger-scale section in FIG. 6, at least some (e.g. 50 to 90%) of the said cells communicate with one another, and in a number of cases, are exactly the same shape and size as the granules contained inside. Other cells, on the other hand, are slightly larger than the said granules, so as to form a minute gap 216 between at least part of the outer surface of the granule and the corresponding inner surface portion of the respective cell.

The arrangement of cells 230, and therefore also of granules 215, inside matrix 214 is entirely random. Though the advantages of the resistor according to the present invention are obtainable even if only a few of cells 230 communicate with one another, it is nevertheless preferable for most of them to do so. For best results, the estimated percentage of communicating cells is around 50–90%.

Though conducting granules 215 may be of any size, this conveniently ranges between 10 and 250 microns. Likewise, granules 15 may be of any shape and, in this case, are preferably irregular, as shown in FIGS. 5 and 6.

Matrix 214 may be formed from any type of electrically insulating material, providing it is flexible enough to flex, when a given pressure is applied on the resistor, and return to its original shape when such pressure is released. Furthermore, the material used for the matrix must be capable of assuming a first state, in which it is sufficiently liquid for it to be injected into a granule structure statistically presenting each of the said granules arranged at least partially contacting the adjacent granules with which it defines a number of gaps; and a second state in which it is both solid and flexible. The viscosity of the liquid material conveniently ranges from 500 to 10,000 centipoise.

Matrix 214 may conveniently be formed from synthetic resin, preferably a synthetic thermoplastic resin, which presents all the aforementioned characteristics and is thus especially suitable for injection into a granule structure of the aforementioned type.

Though the size of granules 215, which depends on the size of the resistor being produced, is not a critical factor, the said granules are preferably very small, ranging in size from 10 to 250 microns.

The conducting material used for the granules may be any type of metal, e.g. iron, copper, or any type of metal alloy, or non-metal material, such as graphite or carbon. The materials for matrix 214 and granules 215 may thus be selected from a wide range of categories, providing they present the characteristics already mentioned.

The material employed for matrix 214 which, as already stated, must be flexible and insulating, is preferably, though not necessarily, so precompressed inside matrix 214 itself as to exert sufficient pressure on particles 215 to maintain contact between the same. It follows, therefore, that each minute element of the said matrix 214 material is in a sufficiently marked state of triaxial precompression as to exert on adjacent elements, in particular particles 215, far greater stress, for producing contact pressure between the surfaces of the said particles, than if the said triaxial precompression were not provided for. As will be made clearer later on, such a state of triaxial precompression is a direct consequence of the process according to the present invention.

With the structure described and shown in FIGS. 5 and 6, the resistor according to the present invention presents an extremely large number of granules 215 of conducting material, which granules either contact one another, or are separated from adjacent granules by extremely small gaps 216 which may be readily bridged when given pressure is applied on the resistor. This results in the formation, inside the said structure, of a number of electrical conductors, each consisting of a chain comprising an extremely large number of granules 215, which are normally already arranged contacting one another inside the said structure. Each of the said chains may electrically connect end surfaces 50 and 60 on the resistor directly, as shown by dotted line Cl in FIG. 5. Alternatively, chains may be formed inside the resistor, as shown by dotted line C2 in FIG. 5, in which the individual granules in the chain are partly arranged contacting one another directly, and partly separated solely by gaps 216. The granules in such chains may be brought into contact, as in the case of chain Cl, by subjecting surfaces 50 and 60 on the resistor to a given pressure sufficient to flex the material of matrix 214 so bridge the said gaps for bringing the adjacent granules separated by the same into direct contact.

The process according to the present invention is as follows.

The first step is to prepare a homogeneous system comprising particles, preferably granules, of a first electrically conductive material arranged in substantially uniform manner inside a mass of a second liquid material which, when solidified, is both electrically insulating and flexible. The mass of the said second liquid material is then solidified to form a supporting matrix for the granules. According to the present invention, throughout solidification of the said second material, a given pressure is applied on the system for the purpose of producing triaxial precompression of the said second material when solidified. Such pressure, which is maintained substantially constant throughout solidification, ranges from a few tenths of a $N/mm^2$ to a few $N/mm^2$.

For forming the said homogeneous system, a granule structure is first formed, which structure statistically presents each granule arranged at least partially contacting the adjacent granules, with which it defines a number of gaps which are then injected with the said second liquid material. The said second material may be liquified by simply heating it to a given temperature. For solidifying it, cooling is usually sufficient. In the case of synthetic resins, however, these must be solidified by means of curing.

The process according to the present invention may comprise the following stages.

Figure 12:
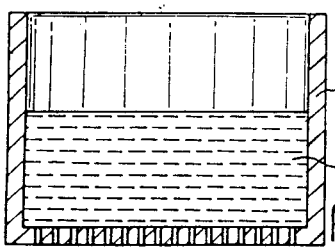

A first stage, in which a mass of electrically conductive granules 116 is formed, for example, inside an appropriate vessel 115 (FIG. 12). For this purpose, the granules, after being poured into the said vessel, are vibrated so as to enable settling. The bottom of vessel 115 is conveniently either porous or provided with holes for letting out the air or gas trapped between the granules.

Figure 13:
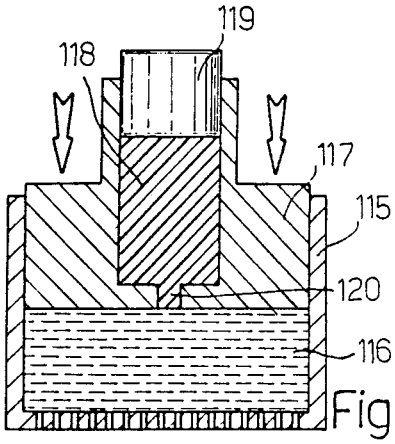

A second stage, as shown in FIG. 13, in which the mass of granules 116 is compacted by subjecting it to a given pressure, e.g. by means of piston 117, applied in any appropriate manner on the upper surface of mass 116. This produces a granule structure in which, statistically, at least part of the surface of each granule is arranged contacting surface portions of the adjacent granules, with gaps inbetween.

Figure 14:
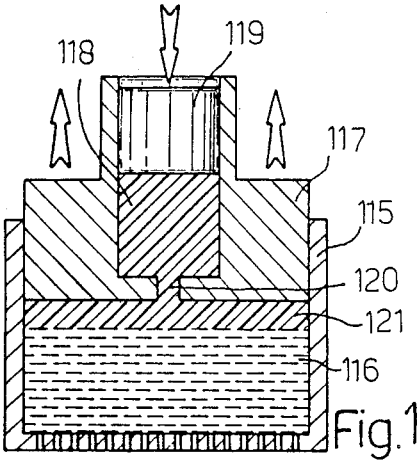
Figure 15:
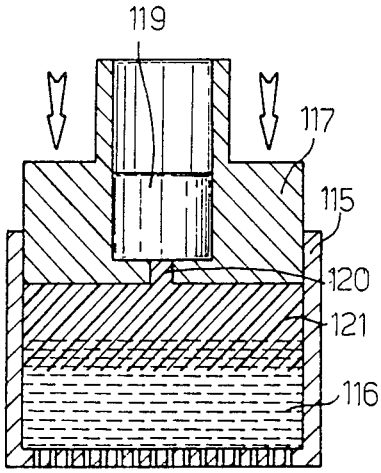

As shown in FIG. 13, piston 117 is conveniently provided with a tank 118 containing the said second material in liquid form; which liquid material may be forced, e.g. by a second piston 119, through hole 120 into a chamber 121 defined between the upper surface of granules 116 and the lower surface of piston 117 as shown clearly in FIG. 14. The said second liquid material in tank 118 is a material which may be solidified and, when it is, is both insulating and flexible. In the event the said material is liquified by heating, appropriate heating means (not shown) are also provided for.

A third stage (FIGS. 14 and 15) in which piston 119 moves down and piston 117 up, so as to force a given amount of the said second liquid material inside chamber 121 (FIG. 14). Piston 117 is then brought down for producing a given pressure inside the liquid material in chamber 121 and so forcing it to flow into the gaps between the granules in mass 116 and form, with the said granules, the said homogeneous system. At the same time, any air between the granules is expelled through the porous bottom of vessel 115. The pressure produced by piston 117, at this stage, inside the liquid material mainly depends on the size of the granules, the viscosity of the liquid, the height of the granule mass being impregnated, and required impregnating time.

Penetration of the liquid material inside the gaps in granule mass 116 has been found to have no noticeable effect on the granule arrangement produced in the compacting stage.

A fourth stage (FIG. 15) in which the homogeneous system of granules and liquid material produced in the foregoing stage is substantially solidified. This may be achieved by simply allowing the system to cool and the said second liquid material to set. At this stage, changes may be observed in the structure of the said second material due, for example, to curing of the same.

Figure 16:
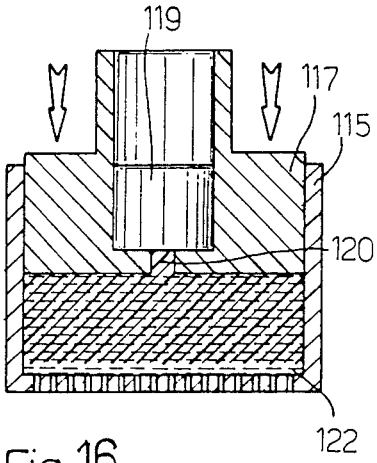

It has been found necessary to dose the liquid material fed into chamber 121 prior to the injection stage, in such a manner as to ensure that it is sufficient to impregnate only a large part of granule mass 116 leaving a nonimpregnated layer 122 (e.g. of about 25%). In like manner, the liquid material flowing inside the gaps between the granules is subjected solely to atmospheric pressure through the porous bottom of vessel 115. The granules, on the other hand, (be they impregnated or not), are subjected to the pressure exerted by piston 117, as shown in FIG. 16. The said pressure is applied evenly over all the contact points between adjacent granules, and is what determines the specific electrical resistance of the resulting material. That is to say, using the same type of granules and liquid material, an increase in the said pressure results, within certain limits, in a reduction of the specific electrical resistance of the resulting material. The said pressure must be maintained constant until the liquid material has set, and must be at least equal or greater than the compacting pressure applied in stage 2 (FIG. 13).

Though the said pressure may be selected from within a very wide range, convenient pressure values have been found to range from a few tenths of a $N/mm^2$ to a few $N/mm^2$. For resistors prepared as described in the following examples, the following pressures were selected:

Example 1 : 1.17 $N/mm^2$
Example 2 : 0.62 $N/mm^2$
Example 3 : 1.56 $N/mm^2$
Example 4 : 2.35 $N/mm^2$
Example 5 : 1.17 $N/mm^2$ The mass of material so formed inside vessel 115 may be cut, using standard mechanical methods, into any shape or size for producing the electric resistor according to the present invention.

To those skilled in the art it will be clear that changes may be made to both the resistor and the process as described and illustrated herein without, however, departing from the scope of the present invention.

In particular, granules 215 arranged inside matrix 214 may be replaced by particles of electrically conductive material of any shape or size, e.g. short fibres.

For preparing the said homogeneous system comprising particles of a first electrically conductive material distributed inside a mass of a second liquid material which, when solidified, is both electrically insulating and flexible, processing stages may be adopted other than those described with reference to FIGS. 12 to 16.

The said homogeneous system, in fact, may be obtained by mixing the said particles mechanically with the said second liquid material, using any appropriate means for the purpose.

According to the aforementioned variation, throughout solidification of the said second material, the said system is forced against a porous (or punched) septum for letting out, through the said septum, at least part of the said second liquid material. The pressure so produced may be maintained until the said second material solidifies, so as to produce the said triaxial precompression in the solidified said second material.

For achieving the said precompression, the said system may be spun throughout solidification of the said second liquid material.

When incorporated in an electric circuit, performance of the resistor according to the present invention is as follows.

If no external pressure is applied on the resistor, and end surfaces 50 and 60 are connected electrically via appropriate conductors, electric current may be fed through the resistor as in any type of rheophore. The density of the current feedable through the resistor has been found to be very high, at times in the region of ten $A/cm^2$. When idle, the resistance of the resistor according to the present invention may, therefore, be low enough to produce an electrical conductor capable of handling a high current density, as required for supplying a circuit component or device. A number of resistance values relative to resistors produced by appropriately selecting the characteristics of the particles and the material of matrix 214, and the parameters of the present process, are shown in the Examples given later on.

Total resistance of the resistor so formed has been found to be constant, and dependent solely on the structure of the resistor, in particular, the number and size of communicating cells 230 in matrix 214, and the number of gaps 216 separating adjacent granules 215.

By appropriately selecting the aforementioned parameters, some of which depend on the process described, a resistor may be produced having a given prearranged resistance. When pressure is applied perpendicularly to surfaces 50 and 60, the electrical resistance measured perpendicularly to the said surfaces is reduced in direct proportion to the amount of pressure applied. FIGS. 7 to 10 show four resistance-pressure graphs by way of examples and relative to four different types of resistors, the characteristics of which will be discussed later on. As shown in the said graphs, the fall in resistance as a function of pressure is a gradual process represented by a curve usually presenting a steep initial portion. Even very light pressure, such as might be applied manually, has been found to produce a considerable fall in resistance. In the case of a resistor having the resistance-pressure characteristics shown in FIG. 10, starting resistance was reduced to less than one percent by simply applying a pressure of around 1 $N/mm^2$ (about 10 $kg/cm^2$). With a different structure and pressures of around 2 $N/mm^2$ (about 20 $kg/cm^2$), starting resistance may be reduced by $\frac{1}{3}$ (as shown in the FIG. 7 graph).

If the pressure applied on the resistor according to the present invention is maintained constant (or zero pressure is applied), electrical performance of the resistor has been found to conform with both Ohm's and Joule's law. For application purposes, it is especially important to prevent the heat generated inside the resistor (Joule effect) from damaging the structure. This obviously entails knowing a good deal about the thermal performance of the material from which the supporting matrix is formed.

Assuming the resistor according to the present invention is capable of withstanding an average maximum temperature of 50° C., under normal heat exchange conditions with an ambient air temperature of 20° C., the density of the current feedable through the resistor ranges from 0.2 $A/cm^2$ (Example 4) to 11 $A/cm^2$ (Example 5) providing no external pressure is applied.

In the presence of external pressure, such favourable performance of the electric resistor according to the present invention is probably due to improved electrical conductivity of granule chains such as C1 and C2 in FIG. 5. In fact, as pressure increases, the conductivity of contacting-granule chains (such as C1) increases due to improved electrical contact between adjacent granules, both on account of the pressure with which one granule is thrust against another, and the increased contact area between adjacent granules. In addition to this, granule chains such as C2, in which the adjacent granules are separated by gaps 216, also become conductive when a given external pressure is applied for bridging the gaps between adjacent pairs of otherwise non-conductive granules.

Total electrical conductivity of the granule chains increases gradually alongside increasing pressure by virtue of matrix 14 being formed from flexible material, and by virtue of the said material being precompressed triaxially. As a result, adjacent granules separated by gaps 216 are gradually brought together, and the contact area of the granules already contacting one another is increased gradually as flexing of the matrix material increases. Each specific external pressure is obviously related to a given resistor structure and a given total conducting capacity of the same. When external pressure is released, the resistor returns to its initial unflexed configuration and, therefore, also its initial resistance rating.

In the said initial unflexed configuration, the electrical performance of the material the resistor is made of has been found to be isotropic, in the sense that the specific resistance of the material is in no way affected by the direction in which it is measured. If, on the other hand, the material the resistor according to the present invention is made of is flexed by applying external pressure in a given direction, the specific resistance of the material has been found to vary continuously in the said direction, depending on the amount and direction of the flexing pressure applied.

To illustrate the electrical performance of the resistor according to the present invention, when subjected to varying external pressure, four resistors featuring different structural parameters will now be examined by way of examples.

A fifth example will also be examined in which the specific resistance of the resistor according to the present invention is sufficiently low for it to be considered a conductor.

EXAMPLE 1

A cylindrical resistor, 12.6 mm in diameter and 7.4 mm high was prepared, as shown in FIGS. 12 to 16, using epoxy resin (VB-BO 15) for matrix 214.

Conducting granules 215 consisted of carbon powder ranging in size from 200 to 250 microns.

On resistors with granules of this sort, the matrix insulating material injected between the granules occupies approximately 56.8% of the total volume of the resistor. The resistor so formed was connected to the electric circuit in FIG. 11 in which it is indicated by number 110. The said circuit comprises a stabilized power unit 111 (with an output voltage, in this case, of 4.5V), a load resistor 112 (in this case, 10 ohm), and a digital voltmeter 113, connected as shown in FIG. 11. Resistor 110 was subjected to pressures ranging from $7.8 \cdot 10^{-2}$ N/mm$^2$ to $196 \cdot 10^{-2}$ N/mm$^2$.

Resistance was measured by measuring the difference in potential at the terminals of resistor 112 using voltmeter 113, and plotted against pressure as shown in the FIG. 7 graph. From a starting figure of 5.4 Ohm, resistance gradually drops down to 1.78 Ohm as the said maximum pressure is reached.

EXAMPLE 2

A cylindrical resistor, 12.6 mm in diameter and 7.2 mm high was prepared as before using an alpha-cyanoacrylatebase resin for matrix 214 and carbon granules ranging in size from 200 to 250 microns.

Once again, the resistor was connected to the FIG. 11 circuit, the components of which presented the same parameters as in Example 1. The relative resistance-pressure graph is shown in FIG. 8, which shows a resistance drop from 16 to 5.25 Ohm between the same minimum and maximum pressures as in Example 1.

EXAMPLE 3

A tubular resistor with an outside diameter of 12.6 mm, an inside diameter of 3.5 mm, and 5.4 mm high was prepared as before, using epoxy resin (VB-BO 15) for the matrix and iron granules ranging in size from 50 to 150 microns. On resistors with granules of this sort, the matrix insulating material injected between the granules occupies approximately 55% of the total volume of the resistor. Resistance was again measured as shown in FIG. 11 using a 1000 Ohm load resistor 112 and 4.5 V power unit 111. Pressure was adjusted gradually from $59 \cdot 10^{-2}$ N/mm$^2$ to 7.22 N/mm$^2$ to give the graph shown in FIG. 9, which shows a resistance drop from 1790 to 493 Ohm between minimum and maximum pressure.

EXAMPLE 4

A 2.4 mm high tubular resistor having the same section as in Example 3 was prepared as before, using silicon resin for matrix 214 and iron granules ranging in size from 50 to 150 microns.

Resistance was again measured on the FIG. 11 circuit, using a 100 Ohm load resistor 112 and a 1.2 V power unit 111. Pressure was adjusted from $4.2 \cdot 10^{-2}$ N/mm$^2$ to $119 \cdot 10^{-2}$ N/mm$^2$ to give the graph shown in FIG. 10 which shows a resistance drop from 1100 to 8.1 Ohm between minimum and maximum pressure.

EXAMPLE 5

A 3.4 mm high tubular resistor having the same section as in Example 4 was prepared as before, using epoxy resin (VB-ST 29) for matrix 214 and tin granules ranging in size from 50 to 200 microns.

Resistance, measured in the absence of external pressure between the two bases of the tubular-section cylinder, was 0.08 Ohm. The specific resistance of the resistor material, in this case, therefore works out at 0.27 Ohm.cm, which is low enough for the resistor to be considered a conductor. Assuming heat (Joule effect) is dissipated by normal heat exchange in air at a temperature of 20° C., and the maximum temperature withstandable by the resistor is 50° C., the density of the current feedable through this resistor is approximately 11 A/cm$^2$.

The said first conducting element 1 conveniently consists simply of a number of metal wires, whereas the said third electric conducting element 5 consists of a plait of metal wires defining a tubular casing.

The said spacer element 2 may be formed differently from the one described herein, and may comprise, for example, a number of separate spacer elements arranged contacting the outer surface 3 of conducting element 1; or a tube of flexible material having perforations for exposing given portions of surface 3 of conducting element 1; or even a braid formed from insulating material.

Conducting elements 1 and 5 may also be structured differently from those described herein.

Figure 4:
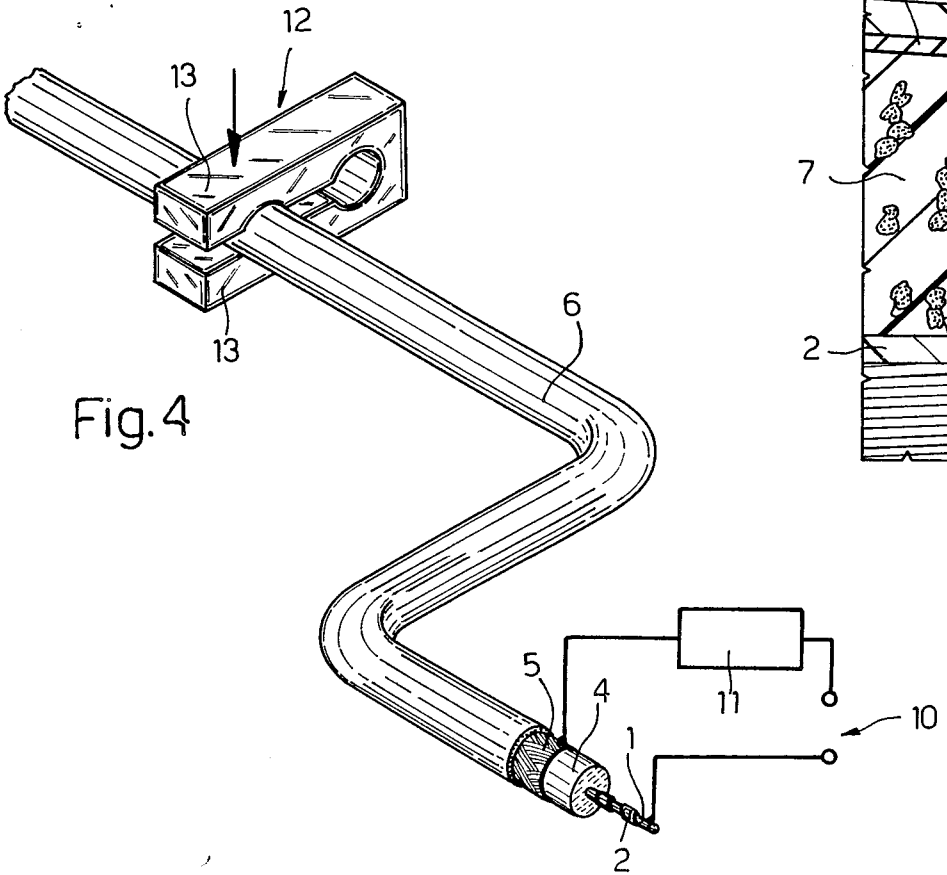
FIG. 4 shows a view in perspective of a length of the conductor according to the present invention connected to an electrical source, a user device, and a device for generating pressure on the conductor and so closing the electric circuit formed by the said components and conductor.

The electric conductor according to the present invention may be connected to an electric circuit as shown in FIG. 4, by series-connecting the first and third electric conductors, 1 and 5, to a current source, of which FIG. 4 shows terminals 10, and to a user device 11. When connected as shown, the conductor may also be operated as a switch, by applying given, relatively low pressure in any manner on the outer surface of the conductor. For this purpose, provision may be made for a grip 12 inside which a length of the conductor is placed, and which provides for exerting substantially radial pressure on the outer surface of the conductor, when arms 13 on the said grip 12 are pressed together in the direction of the conductor axis. Manual pressure applied directly on the conductor by the user, e.g. by gripping the conductor between two fingers, is also sufficient for the purpose.

If no pressure is applied on the outer surface of the conductor, no current circulates in the line so formed. In fact, the said first and third conductors, 1 and 5, connected to the current source and user device, are insulated from each other by spacer element 2; and the portions of surface 3 of conducting element 1 left exposed by the said spacer element 2 are separated from the inner surface of conducting element 4 by a layer of air, thus cutting off current flow between conducting elements 1 and 4.

Figure 2:
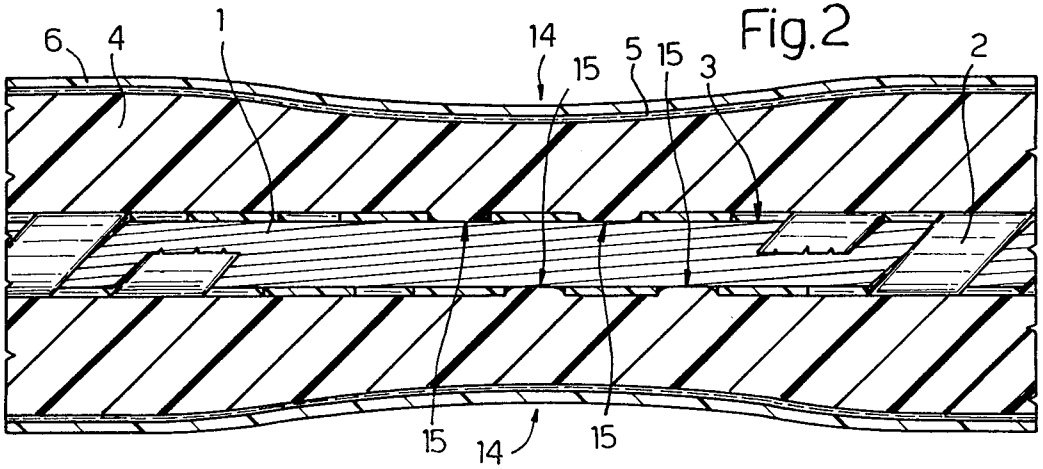
FIG. 2 shows an enlarged longitudinal section of a length of the said conductor.

When, on the other hand, pressure is applied on the outer surface of the conductor according to the present invention, e.g. using grip 12 in FIG. 4, portion 14 (FIG. 2) on which the said pressure is applied flexes radially, substantially as shown in FIG. 2, so as to bring inner surface 15 of the said portion 14 substantially into contact with outer surface 3 of conducting element 1 left exposed by spacer element 2. Localised electrical contact is thus established between conducting elements 1 and 4 on portion 14, thus enabling current to flow substantially radially along conducting element 4, so as to close the FIG. 4 electric circuit inside which current is allowed to flow. Flexed portion 14 of the conductor according to the present invention thus functions as a switch, capable of closing the said circuit when radial pressure is applied on the said portion 14.

The said switch function may, of course, be performed by any short portion along conductor 4, which thus provides, in a simple, straightforward manner, for forming an electric line requiring a number of electric switches. What is more, the said line may be formed with no connections required to switch terminals or electric conductors. Switches formed according to the present invention also provide for greater reliability, by virtue of the contact surfaces for closing the said circuit being airtight and fully insulated from the outside atmosphere.

When pressure is removed from the outer surface of the conductor according to the present invention, the said second conducting element 4 returns to its original shape, thus opening the said circuit. This is achieved by virtue of the high degree of elasticity of the material from which the said conducting element 4 is formed, and the characteristics of which are described in detail in the aforementioned patent application. A further characteristic of the said material is that its electrical conductivity, and therefore also the amount of current flowing along the said line, increases alongside increasing pressure on the material, which favourable property may be employed to advantage in the construction of the said line. Furthermore, by replacing the said conducting element 1 with a calibrated resistor and selectively flexing a number of conductor portions, one at a time, it is possible to determine which of the said portions has been flexed, by measuring total resistance along the line. In other words, the system functions in the same way as a rheostat, the wiper of which is set to various flexure points on element 4.

To those skilled in the art it will be clear that changes may be made to the electric conductor as described and illustrated herein without, however, departing from the scope of the present invention.

I claim:

1. A continuous, flexible electric conductor, characterised by the fact that it comprises a first elongated electric conducting element; a spacer element formed from insulating material and placed over the surface of the said first conducting element, so as to shield all but given portions of the said surface; a second tubular electric conducting element placed over the outside of the said spacer element; a third tubular electric conducting element placed over the outside of the said second element; and a tubular insulating sheath placed over the outside of the said third conducting element; the structure of the said second conducting element comprising a supporting matrix formed from flexible electrically-insulating material and particles of electrically-conductive material scattered in random, substantially uniform manner inside cells on the said matrix; said cells communicating at least partially with one another, and being at least partially larger in size than the respective particles of said electrically-conductive material housed inside the same.

2. An electric conductor as claimed in claim 1, characterised by the fact that the said spacer element consists of a tape wound about the said surface of the said first conducting element.

3. An electric conductor as claimed in claim 1, characterised by the fact that the said first conducting element consists of a number of metal wires.

4. An electric conductor as claimed in claim 1, characterised by the fact that the said third conducting element consists of a metal plait defining a tubular casing.

* * * * *